US009463654B2

(12) United States Patent
Tamai et al.

(10) Patent No.: US 9,463,654 B2
(45) Date of Patent: Oct. 11, 2016

(54) RECORDING APPARATUS

(71) Applicant: SEIKO EPSON CORPORATION, Tokyo (JP)

(72) Inventors: Satoshi Tamai, Matsumoto (JP); Kenji Oshima, Kamiina-gun (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/628,976

(22) Filed: Feb. 23, 2015

(65) Prior Publication Data

US 2015/0251424 A1 Sep. 10, 2015

(30) Foreign Application Priority Data

Mar. 5, 2014 (JP) ..... 2014-042845

(51) Int. Cl.
*B41J 29/02* (2006.01)
*B41J 29/13* (2006.01)
*B41J 2/165* (2006.01)

(52) U.S. Cl.
CPC ..... *B41J 29/02* (2013.01); *B41J 2/16508* (2013.01); *B41J 2/16523* (2013.01); *B41J 2/16532* (2013.01); *B41J 29/13* (2013.01)

(58) Field of Classification Search
CPC ..... B41J 29/02; B41J 29/13; B41J 2/16523; B41J 2/16532; B41J 2/16508; B41J 2/165
USPC ..... 347/22
See application file for complete search history.

(56) References Cited

U.S. PATENT DOCUMENTS

2005/0151782 A1* 7/2005 Ishida ..... B41J 29/02 347/37
2006/0192833 A1* 8/2006 Samoto ..... B41J 29/02 347/108
2007/0126774 A1* 6/2007 Silverbrook ..... B41J 2/16585 347/29
2007/0285453 A1* 12/2007 Kariya ..... B41J 11/46 347/16
2013/0063520 A1* 3/2013 Muraki ..... B41J 29/02 347/36

FOREIGN PATENT DOCUMENTS

JP 05-033588 4/1983
JP 2000-202830 7/2000
JP 2013-209189 10/2013

* cited by examiner

*Primary Examiner* — Matthew Luu
*Assistant Examiner* — Patrick King
(74) *Attorney, Agent, or Firm* — Workman Nydegger

(57) ABSTRACT

A recording apparatus includes a base housing and an upper housing. The base housing has a surrounding wall portion and a bottom wall portion that are formed integrally. A recording head, which performs recording on a medium, is mounted in the inner space of the base housing. The upper housing such as a scanning apparatus is provided over the base housing and has a function of closing the inner space of the base housing. The recording apparatus further includes a part attachment unit and a main board. The part attachment unit is detachably attached to the base housing in the inner space of the base housing. The main board is fixed to the part attachment unit and controls operation of at least the recording head.

9 Claims, 11 Drawing Sheets

RECORDING APPARATUS

BACKGROUND

1. Technical Field

The present invention relates to a recording apparatus that has a base housing.

2. Related Art

An example of a recording apparatus according to prior art is disclosed in JP-A-2013-209189. The apparatus disclosed in this publication includes a base housing made up of divided components, and an upper housing for closing the inner space of the base housing. A main board, on which a CPU for integrated control of the operation of the apparatus is mounted, is fixed in the inner space of the base housing.

If a base housing has a divided structure like that of the above recording apparatus, there is a risk that foreign particles such as dust might go into the inner space of the apparatus from the outside through the joints of the base housing. One possible solution for preventing foreign particles such as dust from entering a recording apparatus is to mold the bottom wall portion and surrounding wall portion of a base housing integrally as a seamless enclosure. However, if the bottom wall portion and surrounding wall portion of a base housing are molded seamlessly, a work space that is available when a main board is mounted onto the inside of the base housing will be restricted. This makes it harder to mount and house the main board into the base housing.

SUMMARY

An advantage of some aspects of the invention is to make it possible to easily mount and house a main board into a base housing of a recording apparatus with effective prevention of the entering of foreign particles into the inner space of the base housing.

Means and operational effects of some aspects of the invention are as follows.

A recording apparatus according to a first aspect of the invention is:

A recording apparatus, comprising:

a recording section that performs recording on a medium;

a base housing that has a surrounding wall and a bottom wall formed integrally, and has an inner space, the recording section being mounted in the inner space of the base housing;

an upper housing that is provided over the base housing and has a function of closing the inner space of the base housing;

a part attachment unit that is detachably attached to the base housing in the inner space of the base housing; and a main board that is fixed to the part attachment unit and controls operation of at least the recording section.

In the structure of the above aspect, since the bottom wall portion and surrounding wall portion of the base housing are molded integrally, the base housing is seamless. Because of this seamless structure, foreign particles do not go into the inner space of the base housing easily from the outside of the recording apparatus.

Since the main board is fixed to the part attachment unit, which is a detachable unit attached to the base housing, it is possible to mount and house the main board into the inner space of the base housing by attaching the part attachment unit to the inside of the base housing. Therefore, it is not necessary to perform attachment work in the inner space of the base housing at the time of mounting and housing the main board into the inner space of the base housing. As compared with the direct mounting of the main board into the seamless base housing, the bottom wall portion and surrounding wall portion of which are molded integrally, this detachable unit attachment structure makes it easier to mount and house the main board into the inner space of the base housing.

In the recording apparatus of the above aspect, it is preferred that the upper housing should be assembled onto the base housing in such a way as to be able to be opened and closed in relation to the base housing. In the above preferred structure, the inner space of the base housing can be opened by opening the upper housing, which functions as a cover for the base housing. Therefore, after the opening of the cover, a user can attach the part attachment unit to the inside of the base housing or detach the part attachment unit from the inside of the base housing.

A recording apparatus according to a second aspect of the invention is:

A recording apparatus, comprising:

a recording section that performs recording on a medium;

a base housing that has a surrounding wall and a bottom wall formed integrally, and has an inner space, the recording section being mounted in the inner space of the base housing;

a cassette that is slidably attached to the base housing in a bottom space of the base housing, the medium, which is to be transported toward the recording section, being stacked in the cassette;

a part attachment unit that is detachably attached to the base housing in the inner space of the base housing; and a main board that is fixed to the part attachment unit and controls operation of at least the recording section.

The structure of the above aspect produces an advantageous effect that foreign particles do not go into the inner space of the base housing easily from the outside of the recording apparatus and an advantageous effect that, as compared with the direct mounting of the main board into the seamless base housing, the bottom wall portion and surrounding wall portion of which are molded integrally, it is easier to mount and house the main board into the inner space of the base housing. In addition, the cassette, into which the medium can be loaded in a stacked state, is slidably attached to the base housing, which is user-friendly because a user can replenish the recording apparatus with the medium easily.

In the recording apparatus of the above aspect, it is preferred that a medium turnover unit for inverting a recording target surface of the medium transported toward the recording section by turning over the medium should be provided inside the base housing. In the above preferred structure, after the completion of recording on one side of the medium by the recording section, the medium turnover unit turns over the medium for recording target surface inversion. Therefore, the recording section can perform recording on the opposite side of the medium. This makes it possible to perform two-sided printing, that is, on both sides of a single sheet of medium, which enriches the functions of the apparatus.

In the recording apparatus of the above aspect, it is preferred that the part attachment unit and the main board should be housed below an opening plane of the base housing. Therefore, when the upper housing is assembled onto the base housing, the collision of the upper housing with the part attachment unit and/or the main board does not occur easily. This makes it easier to assemble the upper housing onto the base housing.

Preferably, the recording apparatus of the above aspect should further comprise: a guide shaft that supports the recording section and is fixed to the part attachment unit. With the above preferred structure, it is possible to mount and house the guide shaft and the recording section into the inner space of the base housing by attaching the part attachment unit to the inside of the base housing. Therefore, it is not necessary to perform attachment work in the inner space of the base housing at the time of mounting and housing the guide shaft and the recording section into the inner space of the base housing. As compared with the direct mounting of the guide shaft and the recording section into the seamless base housing, the bottom wall portion and surrounding wall portion of which are molded integrally, this detachable unit attachment structure makes it easier to mount and house the guide shaft and the recording section into the inner space of the base housing.

Preferably, the recording apparatus of the above aspect should further comprise: a maintenance apparatus that collects, as waste liquid, liquid ejected by the recording section, wherein the maintenance apparatus is fixed inside the base housing.

In the above preferred structure, the recording section is mounted on the part attachment unit, whereas the maintenance apparatus is fixed inside the base housing. Therefore, it is possible to do maintenance on the recording section and maintenance on the maintenance apparatus concurrently by detaching the part attachment unit, on which the recording section is mounted, from the base housing.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to the accompanying drawings, a recording apparatus according to an exemplary embodiment of the invention will now be explained. A recording apparatus according to the present embodiment is an ink-jet printer that performs recording (printing) by ejecting ink, which is an example of liquid, onto a recording target medium, for example, printing paper.

Figure 1:
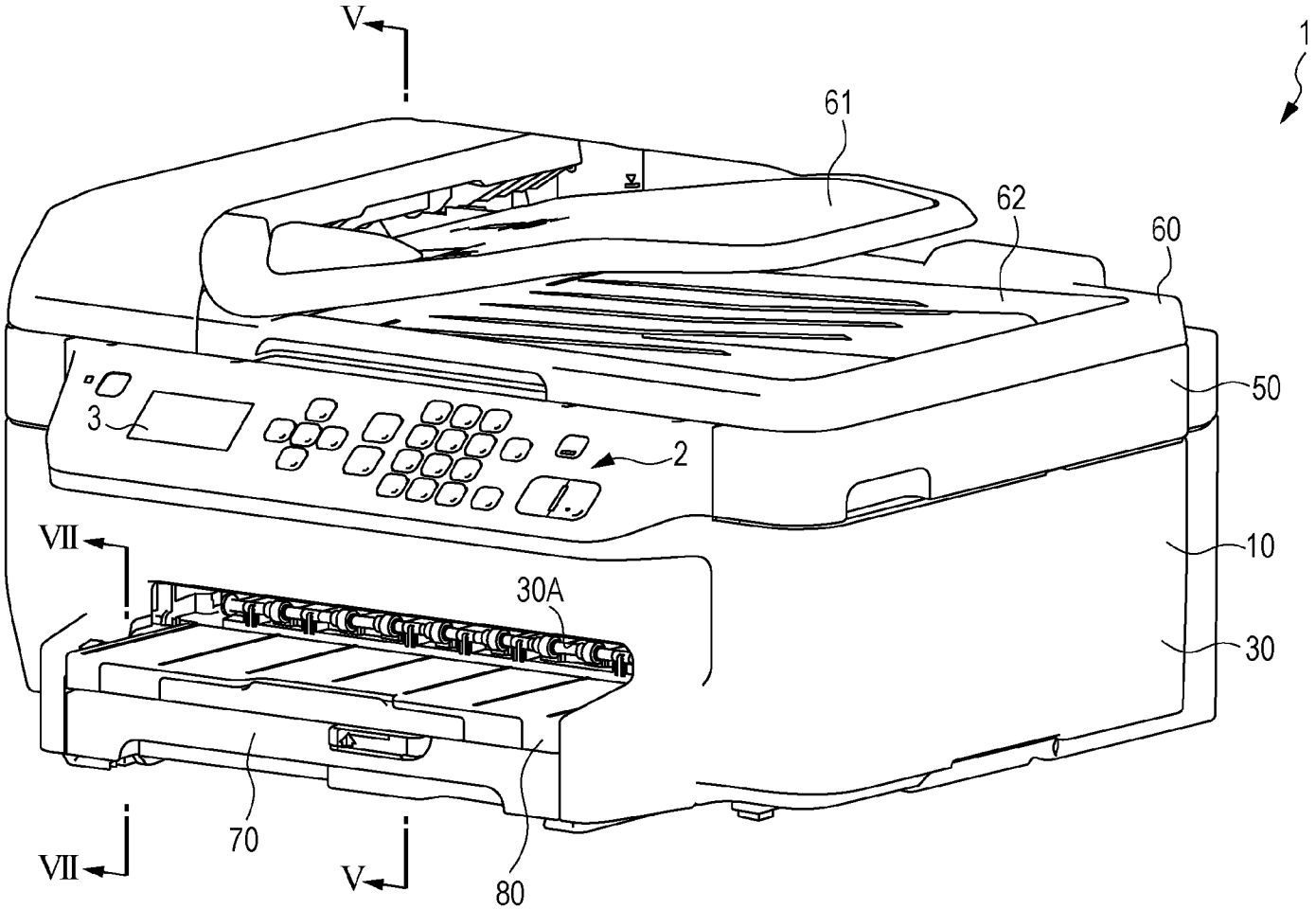
FIG. 1 is a perspective view that schematically illustrates a multifunction printer according to an exemplary embodiment of the invention.

As illustrated in FIG. 1, a multifunction printer 1 includes a recording apparatus 10, which performs recording by ejecting ink, a scanning apparatus 50, which reads information recorded on a medium such as printing paper, and a medium feeding apparatus 60, which feeds printing paper onto the scanning face of the scanning apparatus 50.

The recording apparatus 10 has a bottom wall portion and a surrounding wall portion that are molded integrally as a continuous bottom-and-side enclosure. A base housing 30 of the recording apparatus 10 has an open-topped structure with an inner space. Plural parts and components such as a recording head 17 (refer to FIG. 3) are housed in the inner space of the base housing 30. A cassette 70, into which plural sheets of printing paper can be loaded in a stacked state, is attached at the lowest portion of the recording apparatus 10. The cassette 70 can be moved in a sliding manner in the front/rear direction of the recording apparatus 10.

An extendable stacker 80, which can be drawn/retracted in the front/rear direction of the recording apparatus 10, is provided over the cassette 70. The function of the stacker 80 is to receive and support sheets of printing paper ejected sequentially through a paper-eject opening 30A, which is formed in the front of the base housing 30.

The scanning apparatus 50, which is an example of an upper housing, is hinge-connected (not illustrated) to and over the base housing 30 of the recording apparatus 10, and can be opened and closed pivotally. The scanning apparatus 50 has a cover function of closing the inner space of the base housing 30 of the recording apparatus 10. The scanning apparatus 50 is equipped with a contact image sensor module (not illustrated), etc. for reading information such as an image recorded on printing paper.

The medium feeding apparatus 60 is provided over the scanning apparatus 50. The medium feeding apparatus 60 includes a paper-feed tray 61, on which sheets of printing paper before image scanning by the scanning apparatus 50 are stacked, and a paper-eject tray 62, onto which the printing paper is ejected after the scan. The printing paper set on the paper-feed tray 61 is transported through paper transportation paths (refer to FIG. 5) to the paper-eject tray 62.

An operation panel 2, which is operated by a user for inputting information into the multifunction printer 1, and a display device 3, which displays various kinds of information on the multifunction printer 1, are provided on the front top portion of the multifunction printer 1. For example, a liquid crystal display is used as the display device 3.

Figure 2:
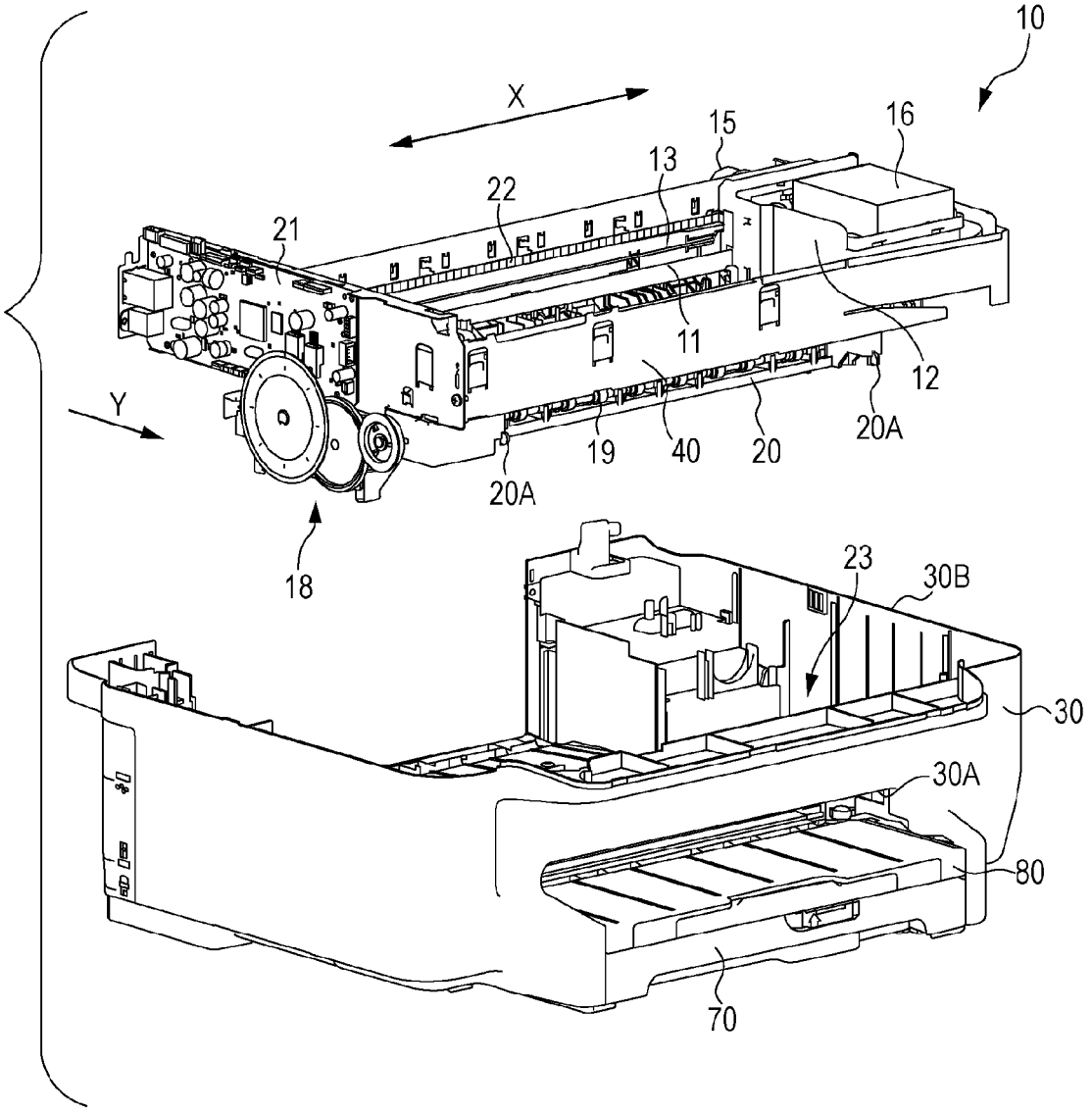
FIG. 2 is an exploded perspective view of a recording apparatus according to the embodiment.
Figure 3:
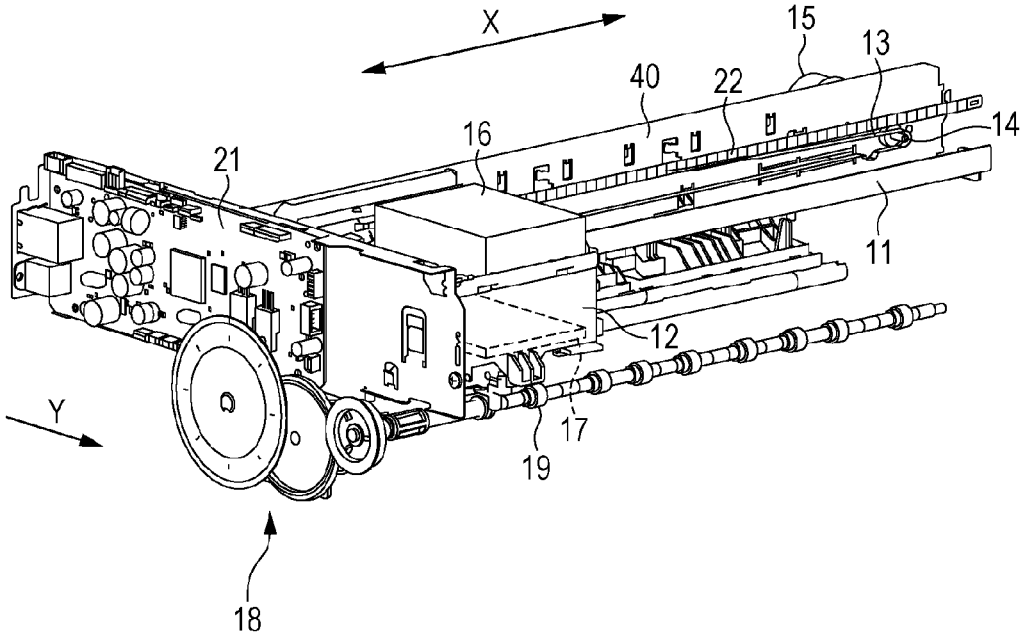
FIG. 3 is a perspective view of a part attachment unit according to the embodiment, and parts mounted on the part attachment unit.

As illustrated in FIGS. 2 and 3, most of plural parts housed in the inner space of the base housing 30 are mounted on a part attachment unit 40, which has a shape like an open-top and open-bottom box. To be mounted in the inner space of the base housing 30, the parts are put into the inner space of the base housing 30 as a result of the attachment of the part attachment unit 40 to the inside of the base housing 30. The part attachment unit 40 and the parts mounted on the part attachment unit 40 are housed below the plane of the opening 30B of the base housing 30. In FIG. 3, to make explanation easier, the front wall of the part attachment unit 40, one sidewall thereof, and a supporting table 20 are not illustrated.

A guide shaft 11, which extends in the length direction of the part attachment unit 40, is fixed to the part attachment unit 40. A carriage 12 is mounted on the guide shaft 11. The carriage 12 can reciprocate in the main-scan direction X (i.e., the length direction of the part attachment unit 40) by traveling along the guide shaft 11.

An endless timing belt 13 is connected to the carriage 12. The endless timing belt 13 is wrapped around, and is stretched between, a pair of pulleys 14, which are provided on the inner surface of the rear plate of the part attachment unit 40. The driving shaft of a carriage motor 15 is coupled to one of the pulleys 14. Due to the rotation of the carriage motor 15 in the normal direction and the reverse direction, the carriage 12 reciprocates in the main-scan direction X.

An ink cartridge 16 is detachably mounted on the carriage 12. The aforementioned recording head 17 is fixed to the bottom of the carriage 12. The recording head 17 ejects ink of each color component, which is supplied from the ink cartridge 16, through nozzles (not illustrated) of the color component.

The abovementioned supporting table 20 for supporting printing paper fed from the cassette 70 (refer to FIG. 1) is fixed inside the part attachment unit 40 under the recording head 17. The supporting table 20 and the recording head 17 face each other. Two stoppers 20A are formed respectively on the two ends of the supporting table 20 in the length direction. The function of the stoppers 20A is to prevent unintended detachment of the stacker 80 (refer to FIG. 1) from the base housing 30.

A paper-feed motor (not illustrated) is provided at the lower left portion of the part attachment unit 40. One of gears that make up a gear train 18 is coupled to the output shaft of the paper-feed motor. The rotation shaft of a transportation roller 19, the function of which is to transport printing paper, is coupled to another gear in the gear train 18. The rotation of the output shaft of the paper-feed motor is transmitted to the transportation roller 19 through the gear train 18. Due to the motor-driven rotation of the transportation roller 19, printing paper is transported in the sub-scan direction Y, which is orthogonal to the main-scan direction X, that is, transported in the shorter-side direction of the part attachment unit 40. Printing operation, in which ink is ejected from the nozzles of the recording head 17 toward printing paper while the carriage 12 is driven to reciprocate in the main-scan direction X, and paper transporting operation, in which the printing paper is transported by a predetermined transportation amount in the sub-scan direction Y, are repeated substantially alternately. In this way, images, characters, etc. are printed onto the printing paper.

A main board 21 is mounted on the left side of the part attachment unit 40. A CPU for integrated control of the operation of the recording apparatus 10, the scanning apparatus 50, and the medium feeding apparatus 60 is mounted on the main board 21. The main board 21 is enclosed by a cover (not illustrated).

A linear encoder 22, which extends along the guide shaft 11, is provided on the part attachment unit 40. The linear encoder 22 is electrically connected to the main board 21. The linear encoder 22 outputs a pulse signal corresponding to the movement position of the carriage 12, the movement direction thereof, and the movement speed thereof, to the CPU of the main board 21. On the basis of the inputted pulse signal, the CPU of the main board 21 controls the speed of the carriage 12 and controls the position thereof.

Figure 4:
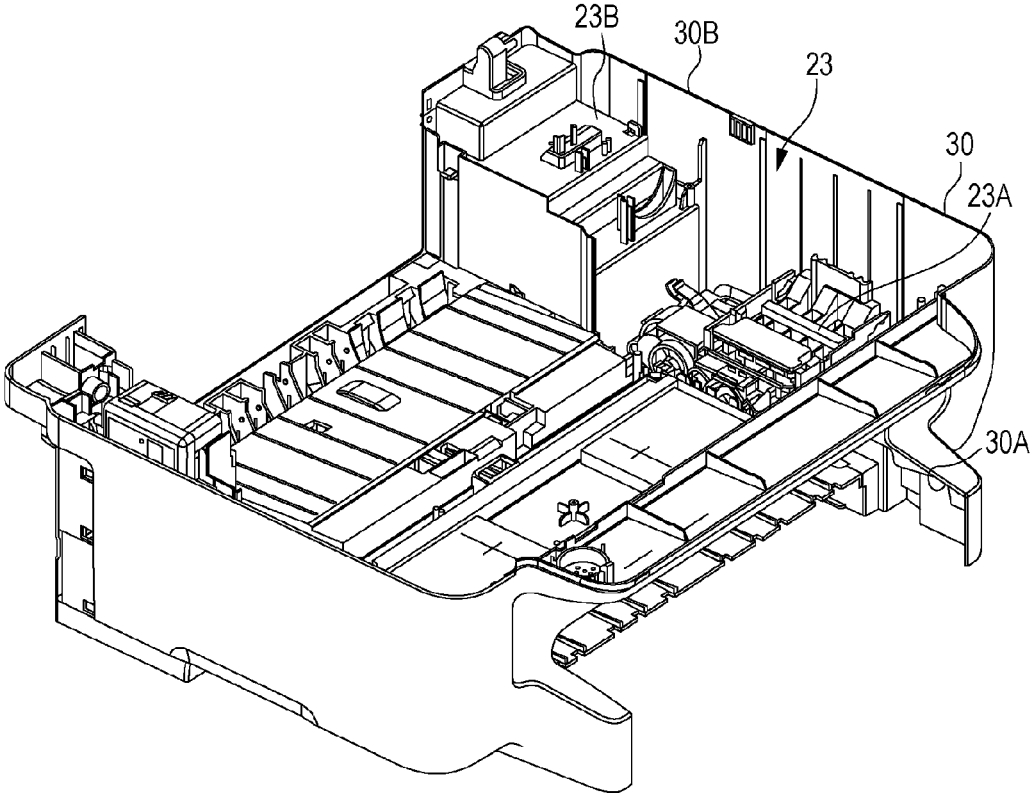
FIG. 4 is a perspective view of a base housing according to the embodiment.

As illustrated in FIG. 4, a maintenance apparatus 23 is fixed inside the base housing 30. The maintenance apparatus 23 is equipped with a cleaner unit 23A, which performs maintenance operation such as suction cleaning so as to keep good ink-ejection performance of the recording head 17. In the suction cleaning, the cleaner unit 23A sucks ink to forcibly remove air bubbles, etc. from the recording head 17. The cleaner unit 23A is located inside the base housing 30 at a position where it is immediately beneath the carriage 12 when the carriage 12 is located at the home position. The home position corresponds to one end (the position in FIG. 2) of the traveling path of the carriage 12 outside the recording area. In addition, the maintenance apparatus 23 is equipped with a waste ink collection box 23B for collection of the ink sucked by the cleaner unit 23A.

Figure 5:
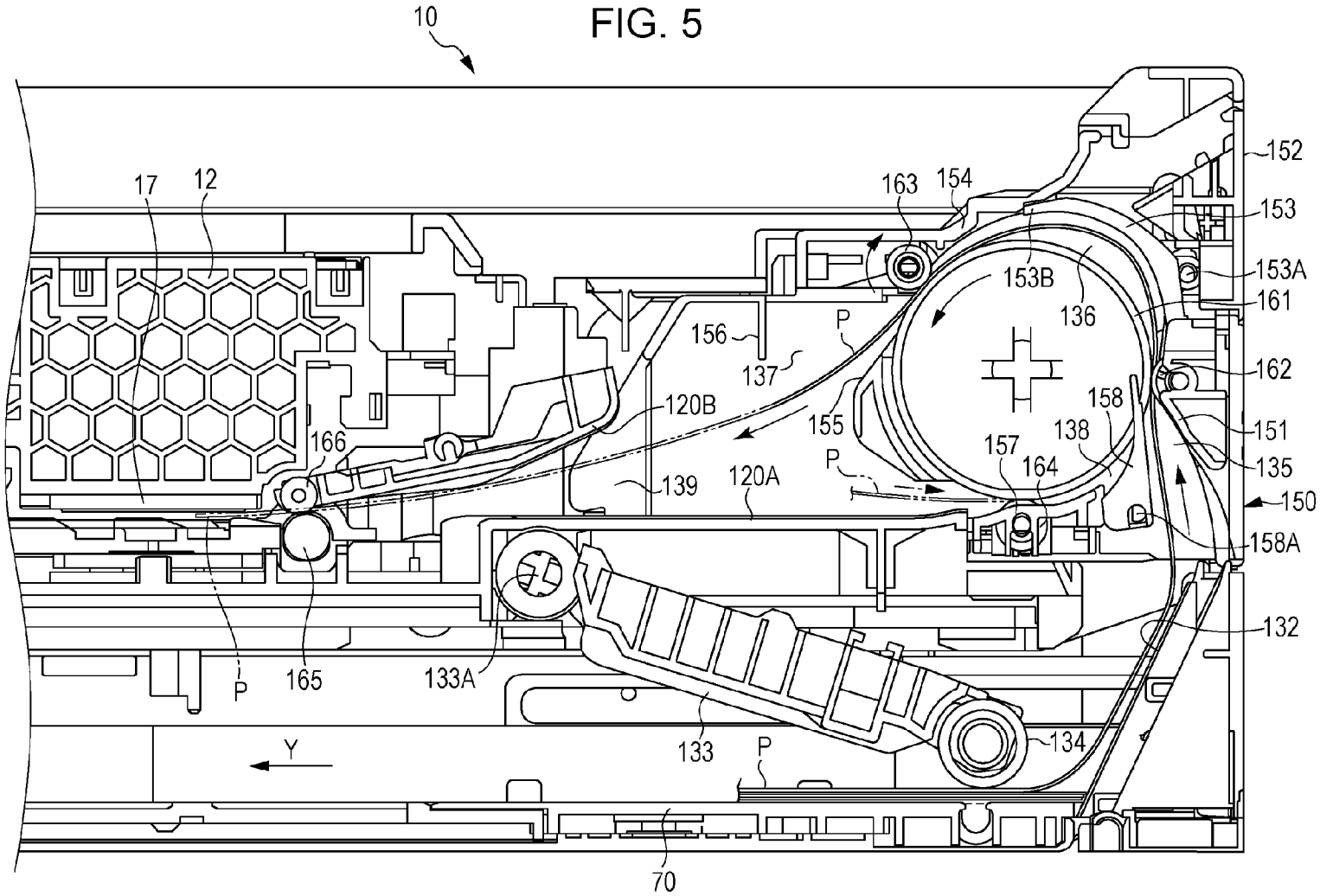
FIG. 5 is a sectional view taken along the line V-V of FIG. 1.

As illustrated in FIG. 5, a turnover unit 150 is provided as a detachable rear component of the recording apparatus 10 at the opposite of the operation panel 2. The turnover unit 150 can be detached from the base housing 30 by being drawn rearward away from the base housing 30. The turnover unit 150 is a mechanism for turning over a sheet of printing paper P fed toward the recording head 17, that is, for inverting a recording target surface, for the purpose of printing on both sides of the printing paper P. The turnover unit 150 may be provided as a unit that can be opened/closed in relation to the base housing 30.

The turnover unit 150 is provided over the cassette 70 inside the base housing 30 at a distal position as viewed in the insertion direction of the cassette 70. Paper transportation paths along which printing paper P fed from the cassette 70 is transported toward the recording head 17 are formed inside the turnover unit 150.

The turnover unit 150 includes plural frame members 151, 152, 155, 156, 157, and 158, which make up a unit frame, flap members 153 and 154, a driving roller 161, which is rotatably mounted on the unit frame, and driven rollers 162, 163, and 164.

The driving roller 161 is rotatably supported by the sidewalls of the frame member 151. Receiving a driving force from a driving source that is not illustrated in the drawing, the driving roller 161 rotates around an axial line that extends in the main-scan direction X. The driving roller 161 forms a nip with the driven roller 162, which is supported by the sidewalls of the frame member 151 and can rotate around an axial line that extends in the main-scan direction X, and a nip with the driven roller 163, which is supported by the sides of the flap member 154 and can rotate around an axial line that extends in the main-scan direction X. The printing paper P gets pinched at the nip between the driving roller 161 and the driven roller. The printing paper P is transported in this pinched state. The driven roller 162 functions as a retard roller. This roller collaborates with the driving roller 161 to ensure that one sheet only of the printing paper P will be fed each time, without any double-sheet feeding or multiple-sheet feeding.

These members and rollers constitute paper transportation paths formed in the turnover unit 150. In a state in which the turnover unit 150 is attached to the base housing 30, the printing paper P is transported along the paper transportation paths from the cassette 70, which is located at the upstream side in the transportation direction, toward the recording head 17, which is located at the downstream side in the transportation direction. More specifically, as viewed in the direction of transportation of the recording paper P, paper transportation paths 135, 136, and 137 are formed continuously in this order in the turnover unit 150.

The transportation path 135 is formed between the frame members 151 and 158 and is surrounded by the front and side wall surfaces of the frame member 151 and the rear and side wall surfaces of the frame member 158 as a space that has an opening in the direction of gravity, that is, toward the cassette 70, inside the turnover unit 150. The transportation path 135 is the first paper transportation path, along which printing paper P is picked up from the cassette 70 by a paper-feed pickup roller 134 and is caused to go up a separation slope 132. The paper-feed pickup roller 134 is provided at the end of a pickup arm 133, which pivots on an arm-turn center shaft 133A. The center shaft 133A is fixed to a component 120A of the base housing 30.

The transportation path 136 is formed downstream of the transportation path 135 in the transportation direction, with a nip formed by the driving roller 161 and the driven roller 162 between these two transportation paths. The transportation path 136 is located above the transportation path 135 and is formed as a curved space along the shape of the circumferential surface of the driving roller 161. The circumferential surface of the driving roller 161 and the respective wall surfaces of two frame members that are not illustrated in the drawing and are formed respectively outside the two side edges of the printing paper P in the paper-width direction constitute the inner wall surfaces of the curved transportation path 136 (the inner curve of the path). The wall surface (lower surface) of the flap member 153, which faces the circumferential surface of the driving roller 161, and a part of the wall surface (lower surface) of the flap member 154 constitute the outer wall surface of the curved transportation path 136 (the outer curve of the path). The rotation shaft 153A of the flap member 153 is rotatably supported by the frame member 152. More specifically, the flap member 153 is configured to be able to pivot on its rotation shaft 153A to change the position of its downstream end 153B in the transportation direction. By this means, the flap member 153 can be opened in relation to the fixed flap member 154 to form a gap therebetween, and can be closed to eliminate the gap therebetween. Alternatively, the flap member 153 may have the above gap-forming/eliminating structure achieved by the pivoting of the flap member 154.

The transportation path 137 is formed downstream of the transportation path 136 in the transportation direction, with a nip formed by the driving roller 161 and the driven roller 163 between these two transportation paths. The transportation path 137 leads from the curved transportation path 136 and is sloped downward toward the front of the apparatus. The transportation path 137 is formed as a space surrounded by a front-side part of the wall surface (lower surface) of the flap member 154, the lower surface of the frame member 156, and the front and side wall surfaces of the frame member 155.

The transportation path 137 leads to a transportation path 139, which is located in front of the transportation path 137. The transportation path 139 has two wall surfaces. One of the two wall surfaces (upper surface) is the lower surface of a component 120B of the base housing 30. The other of the two wall surfaces (lower surface) is the upper surface of the component 120A of the base housing 30. Therefore, the printing paper P having entered the transportation path 137 is further transported to the transportation path 139, which leads from the transportation path 137, and gets pinched by paper-feed rollers 165 and 166, which make up a transportation roller pair that is rotatably supported in the base housing 30. Then, the printing paper P is fed to a recording position beneath the recording head 17 while being pinched by this roller pair. After the completion of recording onto the recording target surface by the recording head 17, the printing paper P is transported in the sub-scan direction Y by a paper-eject roller pair (not illustrated) that is rotatably supported in the base housing 30 to be ejected through the paper-eject opening 30A (refer to FIG. 1).

A transportation path 138, which leads back from the transportation path 137, is formed inside the turnover unit 150 in addition to the transportation paths 135, 136, and 137. The transportation path 138 is located beneath and around the lower rear portion of the driving roller 161. When printing is performed on both sides of a single sheet of printing paper P in the recording apparatus 10, the transportation path 138 is used for turning over the printing paper P and thereby inverting the recording target surface. More specifically, a driving source that is not illustrated in the drawing drives the paper-feed rollers 165 and 166 and causes them to rotate in the reverse direction. Due to the reverse rotation, after the completion of recording on one side by the recording head 17, the printing paper P is transported rearward, that is, in a direction that is the opposite of the sub-scan direction Y. Then, the printing paper P is transported to the transportation path 138 while being pinched by the driving roller 161 and the driven roller 164, which form a nip therebetween.

The transportation path 138 is formed as a space surrounded by lower (one) and upper (the other) wall surface portions. The upper surface of the frame member 157 and the front surface of the frame member 158 make up the lower wall surface portion of the transportation path 138. The circumferential surface of the driving roller 161 and the respective wall surfaces of two frame members that are not illustrated in the drawing and are formed respectively outside the two side edges of the printing paper P in the paper-width direction make up the upper wall surface portion of the transportation path 138.

Figure 6:
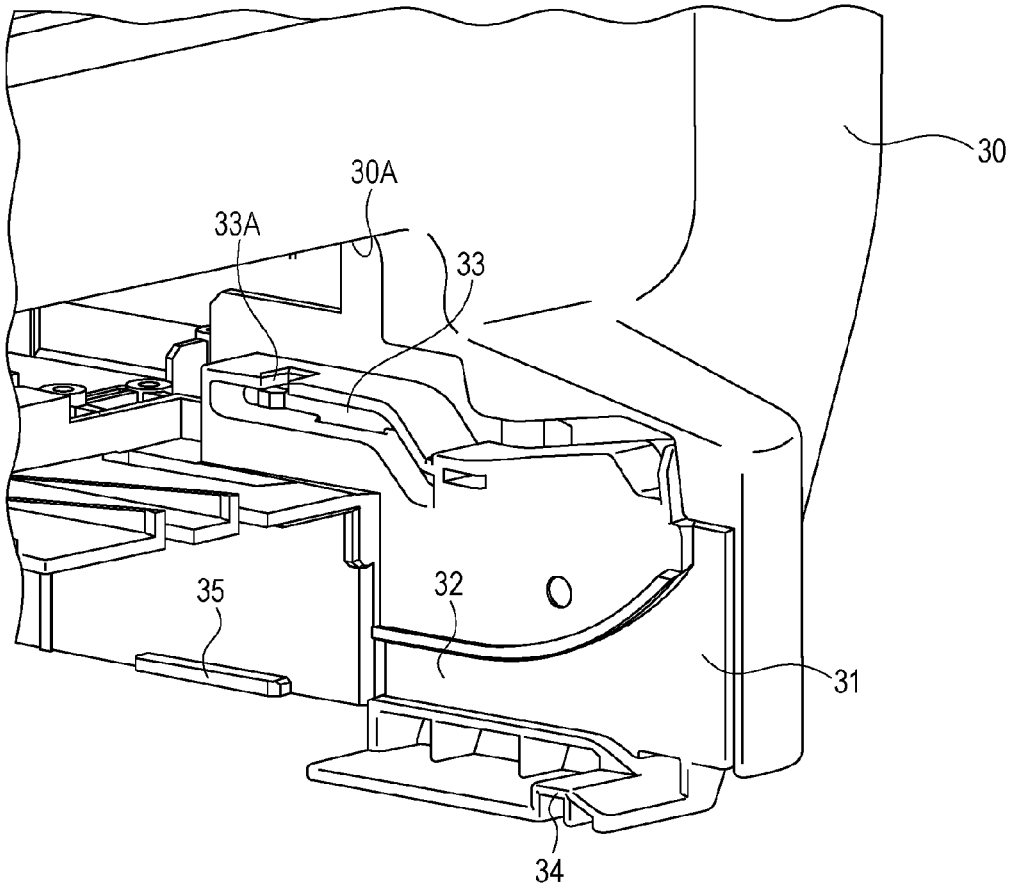
FIG. 6 is a perspective view of a structure at and near a paper-eject opening of the base housing of the embodiment.

The base housing 30 has a paper-eject port portion at which the paper-eject opening 30A is formed, and, as illustrated in FIG. 6, a guide member 31 for guiding the cassette 70 and the stacker 80 (refer to FIG. 1) into the inner space of the base housing 30 is fixed to the inner wall at one end of the paper-eject port portion. Another guide member 31 is fixed to the inner wall at the opposite end of the paper-eject port portion, at which the paper-eject opening 30A of the base housing 30 is formed.

The guide member 31 includes a cassette rail 32, which is a rail for guiding the cassette 70, and a stacker rail 33, which is a rail for guiding the stacker 80. The cassette rail 32 is formed below the stacker rail 33. The cassette rail 32 is curved upward as viewed from the inner space of the base housing 30 outward. A rail-side stopper 34 is formed under the cassette rail 32 (refer to FIG. 7). The function of the rail-side stopper 34 is to prevent the cassette 70 from being drawn out of the inner space of the base housing 30 without any stop.

The stacker rail 33 extends from the inner space of the base housing 30 outward. The outer end portion of the stacker rail 33 is bent or curved downward. The stacker rail 33 has a slit 33A, through which the inner space of the base housing 30 is in communication with a space demarcated by the stacker rail 33.

Figure 7:
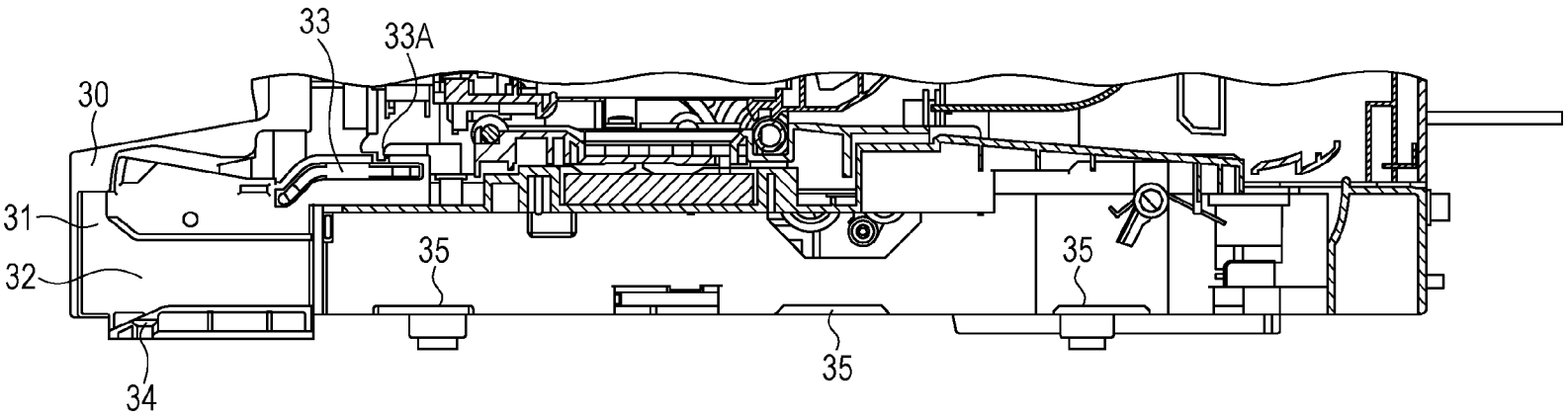
FIG. 7 is a sectional view taken along the line VII-VII of FIG. 1.

As illustrated in FIG. 7, supporting walls 35 for supporting the cassette 70 guided along the cassette rail 32 are formed near the bottom on the one inner wall of the base housing 30. For example, three supporting walls 35 are formed in the depth direction of the base housing 30. Since the cassette 70 is supported by these three supporting walls 35 and the cassette rail 32 at the one end, a user can draw the cassette 70 out of the base housing 30 stably. Another plurality of supporting walls 35 are formed on the opposite inner wall of the base housing 30.

Figure 8:
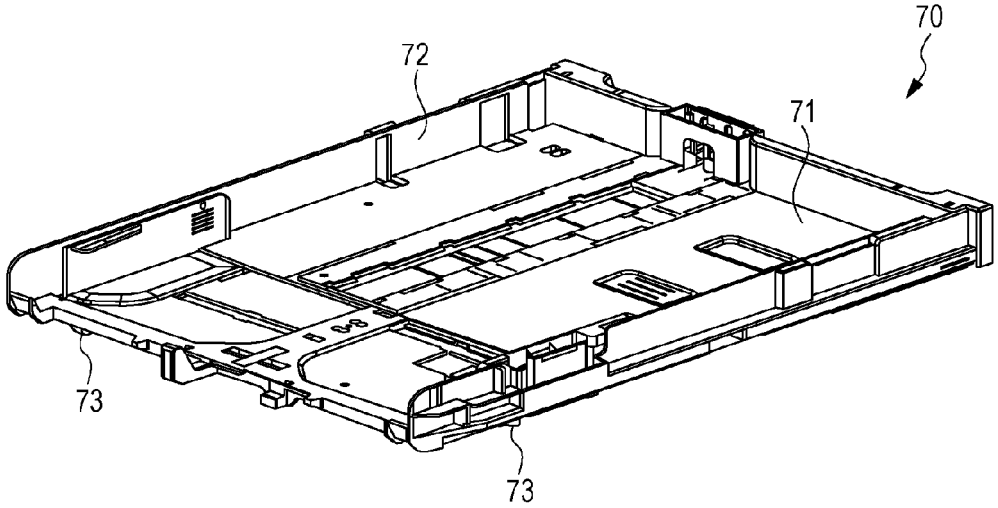
FIG. 8 is a perspective view of a cassette according to the embodiment.

As illustrated in FIG. 8, the cassette 70 has a bottom wall 71, on which sheets of printing paper can be stacked, and surrounding walls 72 rising from the bottom wall 71. The bottom wall 71 is enclosed by the surrounding walls 72 except that no wall is formed at the front of the cassette 70. Therefore, the cassette 70 is open at its front. The cassette 70 is inserted into the inner space of the base housing 30 while being guided along the cassette rails 32 (refer to FIG. 5), with the front open portion of the cassette 70 directed toward the inner space of the base housing 30.

Figure 9:
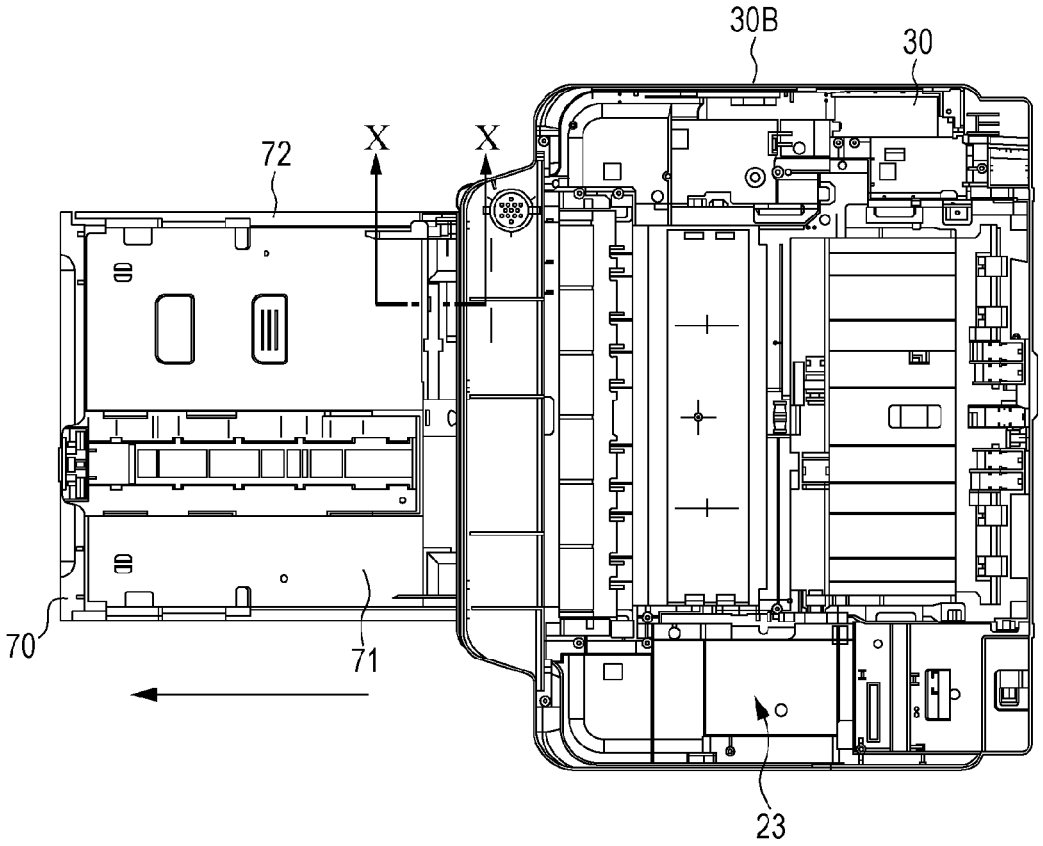
FIG. 9 is a plan view of the base housing of the embodiment, and the cassette thereof.

Cassette-side stoppers 73, which can be brought into engagement with the rail-side stoppers 34 (refer to FIG. 6) of the cassette rails 32 respectively, are formed on the bottom plate 71. As illustrated in FIG. 9, a user can pull out the cassette 70 housed in the base housing 30 in a direction indicated by an arrow.

Figure 10:
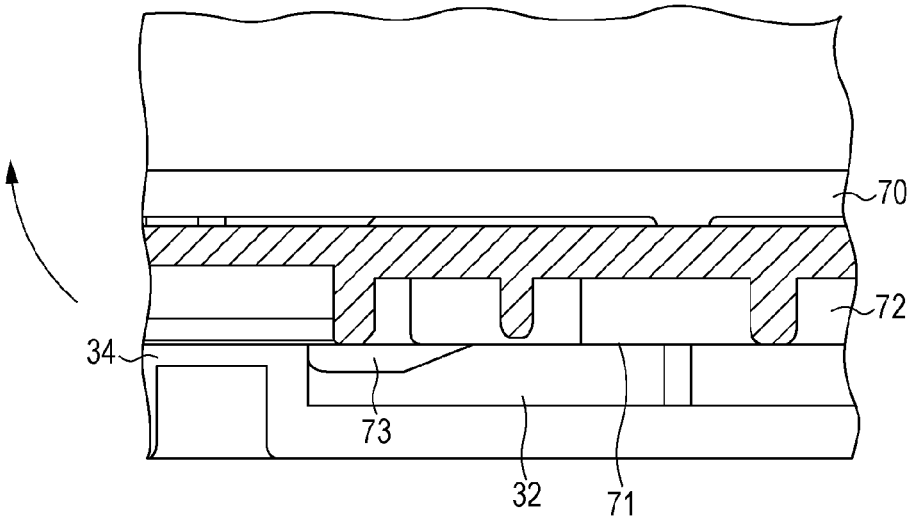
FIG. 10 is a sectional view taken along the line X-X of FIG. 9.

As illustrated in FIG. 10, when the cassette 70 is drawn out of the base housing 30, the cassette-side stopper 73 is brought into engagement with the rail-side stopper 34 at each of the two ends. Because of this stopper engagement, the cassette 70 is temporarily stopped during the process of being drawn out of the base housing 30. Without this stopper structure, there is a risk of dropping the cassette 70 when a user draws the cassette 70 out of the base housing 30 with a great force carelessly. The stopper engagement reduces such a risk. In a state in which the cassette-side stopper 73 is in engagement with the rail-side stopper 34 at each of the two ends, the user turns the cassette 70 in the direction of the curve of the cassette rail 72 as indicated by an arrow in the drawing. As a result of the turn of the cassette 70, the cassette-side stopper 73 becomes disengaged from the rail-side stopper 34 at each of the two ends. Therefore, the user can draw the cassette 70 out of the base housing 30.

Figure 11:
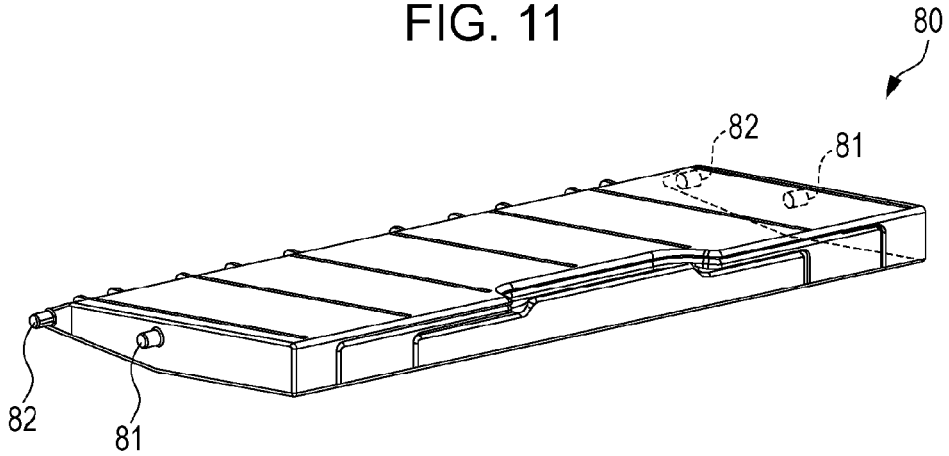
FIG. 11 is a perspective view of a stacker according to an embodiment.

As illustrated in FIG. 11, two first projections 81 and two second projections 82, which are to be inserted into the stacker rails 33 (refer to FIG. 6), are formed on the two sides of the stacker 80.

Figure 12:
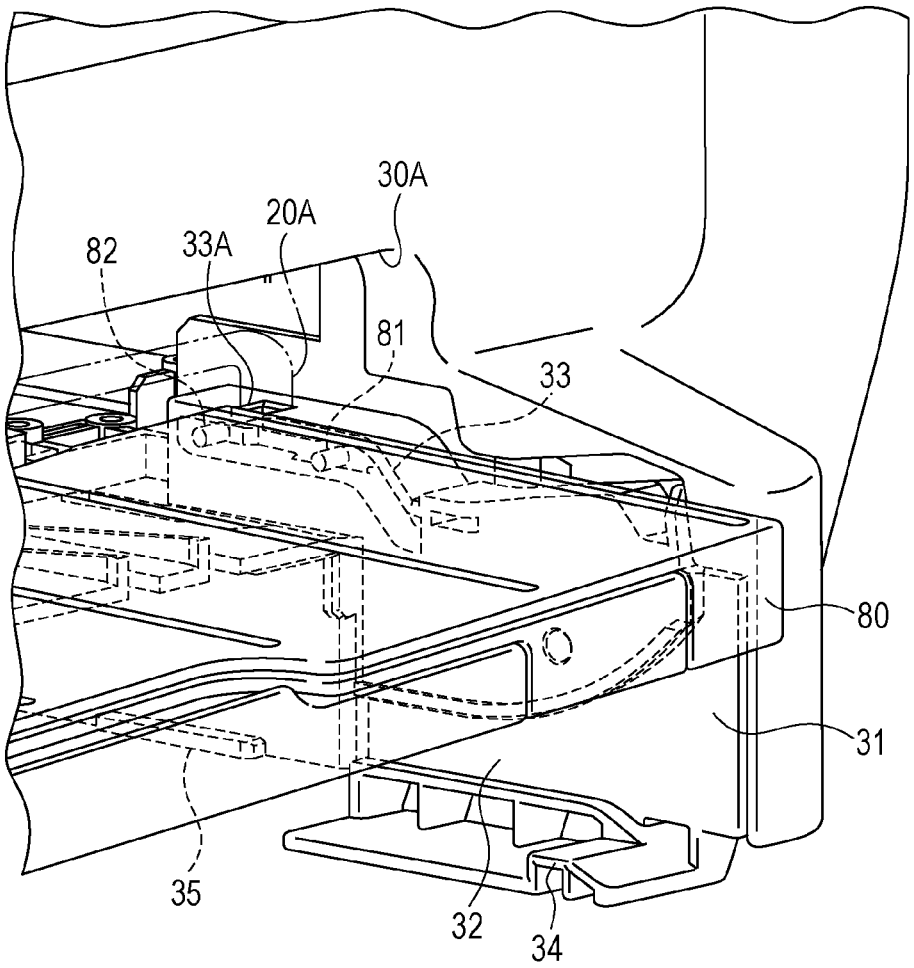
FIG. 12 is a perspective view of a structure at and near the paper-eject opening of the base housing of the embodiment, with the stacker attached thereto.

The first projection 81 is formed substantially at the center of each side of the stacker 80 in the depth direction. The second projection 82 is formed at one end of each side of the stacker 80 in the depth direction. As illustrated in FIG. 12, the stacker 80 can be fixed to the base housing 30 by insertion of the first projection 81 and two second projection 82 in this order into the stacker rail 33 through the slit 33A at each of the two ends via the inner space of the base housing 30. In a state in which the part attachment unit 40 (refer to FIG. 2) is housed inside the base housing 30, the slit 33A is covered by the slit-closing stopper 20A at each of the two ends as indicated by a two-dot chain line in the drawing. This stopper prevents the two second projection 82 from getting out through the slit 33A.

The operation of the recording apparatus 10 will now be explained.

As illustrated in FIGS. 2 and 3, the guide shaft 11, the carriage 12, the timing belt 13, the pair of pulleys 14, the carriage motor 15, and the ink cartridge 16 are mounted on or fixed to the part attachment unit 40. These parts constitute an example of parts housed inside the recording apparatus 10. In addition to these parts, the recording head 17, the gear train 18, the supporting table 20, the transportation roller 19, the main board 21, and the linear encoder 22 are mounted on or fixed to the part attachment unit 40.

The part attachment unit 40, together with these parts, is attached to the inside of the base housing 30. The constituent parts of the recording apparatus 10 are mounted and housed into the inner space of the base housing 30 as a result of the attachment of the part attachment unit 40 to the inside of the base housing 30.

At the time of maintenance on the constituent parts of the recording apparatus 10, the part attachment unit 40, which these parts are mounted on or fixed to, is detached from the base housing 30. Because of this detachable modularized unit structure, it is possible to do maintenance outside the base housing 30 on the parts, which were housed inside the base housing 30 before the detachment.

Next, the operation of feeding the recording paper P from the cassette 70 will now be explained.

As illustrated in FIG. 5, in a case where the printing paper P is fed from the cassette 70, first, the printing paper P picked up by the paper-feed pickup roller 134 is fed to the transportation path 135. The printing paper P gets pinched between the driving roller 161, which rotates in a direction indicated by an arrow in the drawing, and the driven roller 162. The printing paper P pinched therebetween is transported from the transportation path 135 to the transportation path 136. At the transportation path 136, the printing paper P moves along the wall surface (lower surface) of the flap member 153 and a part of the wall surface (lower surface) of the flap member 154. The printing paper P gets pinched between the driving roller 161, which functions as a feeder roller, and the driven roller 163. The printing paper P pinched therebetween is transported from the transportation path 136 to the transportation path 137 as indicated by an arrow in the drawing.

The printing paper P thereafter moves from the transportation path 137 to the transportation path 139. In a state in which the printing paper P remains pinched by the driving roller 161 and the driven roller 163 at the nip therebetween, the leading edge portion of the printing paper P gets pinched by the paper-feed rollers 165 and 166, which make up a pair. The printing paper P is fed to a recording position beneath the recording head 17. Then, the printing paper P fed by the roller pair is transported in the sub-scan direction Y. Therefore, at the turnover unit 150, the printing paper P is transported from the transportation path 136 to the transportation path 137, and thereafter from the transportation path 137 to the transportation path 139, successively due to the rotation of the driving roller 161 and the driven rollers 162 and 163 until the leading edge portion of the printing paper P gets pinched by the paper-feed rollers 165 and 166 and receives a feeding force therefrom.

When printing is performed on both sides of a single sheet of printing paper P, as indicated by a two-dot chain line in the drawing, after the completion of recording on one side by the recording head 17, the printing paper P is transported in the reverse direction (a broken-line arrow in the drawing) from the recording position beneath the recording head 17 to the transportation path 138. The frame member 158 pivots on its rotation shaft 158A, which is rotatably supported by the frame member 157. The printing paper P having entered the transportation path 138 is fed with this pivoting operation to the transportation path 135 again. Driven by the driving roller 161, the printing paper P moves along the curved transportation path 136 again. In the movement along the transportation path 136 mentioned above, the direction of the movement of the printing paper P is inverted from the backward movement to the forward movement. The recording paper P is in a turned-over state, with the not-yet-recorded face up, when it is fed to the transportation path 137 again. Therefore, recording is performed on this opposite side by the recording head 17.

The embodiment described above produces the following advantageous effects.

(1) Since the bottom wall portion and surrounding wall portion of the base housing 30 are molded integrally, the base housing 30 is seamless. Because of this seamless structure, foreign particles do not go into the inner space of the base housing 30 easily from the outside of the recording apparatus 10.

(2) Since the main board 21 is fixed to the part attachment unit 40, which is a detachable unit attached to the base housing 30, it is possible to mount and house the main board 21 into the inner space of the base housing 30 by attaching the part attachment unit 40 to the inside of the base housing 30. Therefore, it is not necessary to perform board attachment work in the inner space of the base housing 30 at the time of mounting and housing the main board 21 into the inner space of the base housing 30. As compared with the direct mounting of the main board 21 into the seamless base housing, the bottom wall portion and surrounding wall portion of which are molded integrally, this detachable unit attachment structure makes it easier to mount and house the main board 21 into the inner space of the base housing 30.

(3) The inner space of the base housing 30 can be opened by pivotally opening the scanning apparatus 50, which functions as a cover for the base housing 30. Therefore, after the opening of the cover, a user can attach the part attachment unit 40 to the inside of the base housing 30 or detach the part attachment unit 40 from the inside of the base housing 30.

(4) The cassette 70, into which sheets of printing paper P can be loaded in a stacked state, is slidably attached to the base housing 30, which is user-friendly because a user can replenish the recording apparatus 10 with the printing paper P easily.

(5) After the completion of recording on one side of printing paper P by the recording head 17, the medium turnover unit 150 turns over the printing paper P so that the recording head 17 can perform recording on the opposite side of the recording paper P. This makes it possible to perform two-sided printing, that is, on both sides of a single sheet of printing paper P, which enriches the functions of the apparatus.

(6) The part attachment unit 40 and the main board 21 are housed below the plane of the opening 30B of the base housing 30. Therefore, when the scanning apparatus 50 is assembled onto the base housing 30, the collision of the scanning apparatus 50 with the part attachment unit 40 and/or the main board 21 does not occur easily. This makes it easier to assemble the scanning apparatus 50 onto the base housing 30.

(7) It is possible to mount and house the guide shaft 11 and the recording head 17 into the inner space of the base housing 30 by attaching the part attachment unit 40 to the inside of the base housing 30. Therefore, it is not necessary to perform guide/head attachment work in the inner space of the base housing 30 at the time of mounting and housing the guide shaft 11 and the recording head 17 into the inner space of the base housing 30. As compared with the direct mounting of the guide shaft 11 and the recording head 17 into the seamless base housing, the bottom wall portion and surrounding wall portion of which are molded integrally, this detachable unit attachment structure makes it easier to mount and house the guide shaft 11 and the recording head 17 into the inner space of the base housing 30.

(8) It is possible to mount and house the linear encoder 22 into the inner space of the base housing 30 by attaching the part attachment unit 40 to the inside of the base housing 30. Therefore, it is not necessary to perform encoder attachment work in the inner space of the base housing 30 at the time of mounting and housing the linear encoder 22 into the inner space of the base housing 30. As compared with the direct mounting of the linear encoder 22 into the seamless base housing, the bottom wall portion and surrounding wall portion of which are molded integrally, this detachable unit attachment structure makes it easier to mount and house the linear encoder 22 into the inner space of the base housing 30.

(9) The recording head 17 is mounted on the part attachment unit 40, whereas the maintenance apparatus 23 is fixed inside the base housing 30. Therefore, it is possible to do maintenance on the recording head 17 and maintenance on the maintenance apparatus 23 concurrently by detaching the part attachment unit 40, on which the recording head 17 is mounted, from the base housing 30.

(10) It is possible to do maintenance on the parts mounted on the part attachment unit 40 outside the base housing 30 by detaching the part attachment unit 40 from the base housing 30. The detachment of the part attachment unit 40 widens a work space that is available for doing maintenance on the parts, which were housed inside the base housing 30 before the detachment. This makes it easier to do maintenance on these parts.

(11) Since the bottom wall portion and surrounding wall portion of the base housing 30 are molded integrally, the base housing 30 offers greater mechanical strength than that of a divided structure, in which the base housing 30 is made of plural components.

(12) Since the bottom wall portion and surrounding wall portion of the base housing 30 are molded integrally, the base housing 30 is seamless. Such a seamless design makes the recording apparatus 10 looks better.

The foregoing embodiment may be modified as follows. The modified embodiments described below may be combined with each other as long as they contradict each other technically.

At least one of the parts mounted on the part attachment unit 40, except for the main board 21, may be mounted on the base housing 30.

The scanning apparatus 50 and the medium feeding apparatus 60 may be omitted. The inner space of the base housing 30 is closed by a cover, which is an upper housing according to this modified embodiment.

In the foregoing embodiment, the recording apparatus 10 may be a printer that ejects liquid other than ink. Each droplet jetted out from the head of the printer as a very small amount of the liquid includes but not limited to a particulate droplet, a tear-shaped droplet, and a viscous/thready droplet that forms a thread tail. The "liquid" mentioned herein may be made of any material as long as it can be ejected from the recording apparatus 10. For example, a substance/matter that is in the liquid phase can be used as the material. Some non-limiting examples of the material are: liquid that has high viscosity or low viscosity, sol or gel water, or other liquid/liquefied matter/material such as inorganic solvent, organic solvent, solution, liquid resin, or liquid metal (e.g., metal melt). The "liquid" is not limited to liquid as a state of matter. It encompasses a liquid/liquefied matter/material that is made as a result of dissolution, dispersion, or mixture of particles of a functional material made of a solid such as pigment, metal particles, or the like into/with a solvent, though not limited thereto.

The entire disclosure of Japanese Patent Application No.: 2014-042845, filed Mar. 5, 2014 is expressly incorporated by reference herein.

What is claimed is:

1. A recording apparatus, comprising:

a recording section that performs recording on a medium;

a base housing that has a surrounding wall and a bottom wall formed integrally, and has an inner space, the recording section being mounted in the inner space of the base housing;

an upper housing that is provided over the base housing and has a function of closing the inner space of the base housing; and a part attachment unit that is detachably attached to the base housing in the inner space of the base housing, wherein the part attachment unit includes:

a main board that is fixed to a side of the part attachment unit and controls operation of at least the recording section;

a guide shaft that is fixed to the part attachment unit and that supports the recording section so that the recording section can move in a main scan direction that is the length direction of the part attachment unit; and a supporting table that is fixed inside the part attachment unit under the recording section and that supports the medium.

2. The recording apparatus according to claim 1, further comprising:

a maintenance apparatus that collects, as waste liquid, liquid ejected by the recording section, wherein the maintenance apparatus is fixed inside the base housing.

3. The recording apparatus according to claim 2, wherein the upper housing is assembled onto the base housing in such a way as to be able to be opened and closed in relation to the base housing.

4. The recording apparatus according to claim 2, wherein the upper housing is a reader that can read a medium image.

5. The recording apparatus according to claim 2, wherein a medium turnover unit for inverting a recording target surface of the medium transported toward the recording section by turning over the medium is provided inside the base housing.

6. The recording apparatus according to claim 1, wherein a medium turnover unit for inverting a recording target surface of the medium transported toward the recording section by turning over the medium is provided inside the base housing.

7. The recording apparatus according to claim 2, wherein the part attachment unit and the main board are housed below an opening plane of the base housing.

8. The recording apparatus according to claim 3, wherein the part attachment unit and the main board are housed below an opening plane of the base housing.

9. The recording apparatus according to claim 1, further comprising:

a motor that drives the recording section.

* * * * *